US011475725B2

(12) United States Patent
Studerus

(10) Patent No.: US 11,475,725 B2
(45) Date of Patent: Oct. 18, 2022

(54) DEVICE AND METHOD FOR ACCESS CONTROL

(71) Applicant: dormakaba Schweiz AG, Rümlang (CH)

(72) Inventor: Paul Studerus, Oberweningen (CH)

(73) Assignee: DORMAKABA SCHWEIZ AG, Rümlang (CH)

( * ) Notice: Subject to any disclaimer, the term of this patent is extended or adjusted under 35 U.S.C. 154(b) by 0 days.

(21) Appl. No.: 17/271,404

(22) PCT Filed: Jun. 25, 2019

(86) PCT No.: PCT/EP2019/066897

§ 371 (c)(1),
(2) Date: Feb. 25, 2021

(87) PCT Pub. No.: WO2020/043346

PCT Pub. Date: Mar. 5, 2020

(65) Prior Publication Data

US 2021/0304535 A1 Sep. 30, 2021

(30) Foreign Application Priority Data

Aug. 30, 2018 (CH) ..... 01043/18

(51) Int. Cl.
*G07C 9/00* (2020.01)

(52) U.S. Cl.
CPC ..... *G07C 9/00309* (2013.01); *G07C 2009/00373* (2013.01); *G07C 2209/63* (2013.01)

(58) Field of Classification Search
None
See application file for complete search history.

(56) References Cited

U.S. PATENT DOCUMENTS

2013/0181839 A1* 7/2013 Cao ..... G06Q 10/087 340/572.1
2014/0292481 A1 10/2014 Dumas et al.
(Continued)

FOREIGN PATENT DOCUMENTS

| | | | |
|---|---|---|---|
| GB | 2496755 | A | 5/2013 |
| WO | WO 2014/064296 | A1 | 5/2014 |
| WO | WO 2018/071671 | A2 | 4/2018 |

OTHER PUBLICATIONS

International Search Report and Written Opinion of the International Searching Authority for International Application No. PCT/EP2019/066897, dated Sep. 27, 2019, in 17 pages.

*Primary Examiner* — Carlos Garcia
(74) *Attorney, Agent, or Firm* — Knobbe, Martens, Olson & Bear, LLP

(57) ABSTRACT

Device, method, and computer program product for access control, the device comprising an ultra-wideband transceiver (12) connected to a first electronic circuit (11); wherein the first electronic circuit (11) is configured to activate (S1) periodically the ultra-wideband transceiver (12) to receive ultra-wideband transmissions (T) from a mobile device (2), upon reception (S2) of an ultra-wideband transmission (T) from a mobile device (2), to activate the ultra-wideband transceiver (12) to transmit (S3) to the mobile device (2) a reguest message and to receive (S5) from the mobile device (2) a response message, to determine (S6) a distance (d) of the mobile device (2) from the access control terminal (1), using the response message, and to execute access control, if the mobile device (2) is within a pre-determined proximity range (P).

18 Claims, 2 Drawing Sheets

(56) References Cited

U.S. PATENT DOCUMENTS

| | | | | |
|---|---|---|---|---|
| 2014/0330449 | A1* | 11/2014 | Oman | B60R 25/01 701/2 |
| 2015/0077226 | A1 | 3/2015 | Lin | |
| 2018/0162321 | A1* | 6/2018 | Spiess | G07C 9/29 |
| 2019/0392659 | A1* | 12/2019 | Seenivasagam | H04W 12/06 |
| 2021/0408837 | A1* | 12/2021 | Yang | G01V 3/101 |

* cited by examiner

DEVICE AND METHOD FOR ACCESS CONTROL

CROSS-REFERENCE TO RELATED APPLICATIONS

This application is the U.S. National Phase under 35 U.S.C. § 371 of International Application PCT/EP2019/066897, filed Jun. 25, 2019, which claims priority to CH Application No. 01043/18, filed Aug. 30, 2018, the entire contents of each of which are incorporated by reference herein and made a part of this specification.

FIELD OF THE INVENTION

The present invention relates to a device and a method for access control. Specifically, the present invention relates to an access control terminal and an access control method between an access control terminal and a mobile device.

BACKGROUND OF THE INVENTION

Keyless entry systems have become widely used in applications ranging from vehicle entry systems and vehicle access control, to building and room access control. For very close-range applications, a radio-frequency identification (RFID) transponder (or tag) is often used, which has mostly replaced earlier magnetic stripe cards. Other current solutions use infra-red systems or radio systems to transmit an authenticating signal from a user device to a vehicle security system or to a building access control terminal. The authentication can be initiated either by the user, for instance by pressing a button on the user device, or from the access control terminal itself which periodically transmits request signals and waits for a response message.

Installing and wiring access control terminals is typically time-consuming and expensive, as installation may require extensive wiring, and powering the locks needs a permanent connection to mains power. Therefore only the most crucial doors are fitted with an access control terminal and incorporated into an access control system. These costs are even higher when an existing building is retrofitted to include access control systems, as new wiring may have to be run through existing walls. Some improvements have taken place, for example there now exist access control terminals comprising wireless modules such as Wi-Fi modules which can connect to a wireless network, removing the need to provide a wired connection for data communication. Similarly, battery powered access control terminals are available, however these often require regular exchange of batteries and so remain inefficient with regards to upkeep and maintenance.

SUMMARY OF THE INVENTION

It is an object of this invention to provide a device and a method for access control. In particular, it is an object of the present invention to provide an access control terminal and an access control method between an access control terminal and a mobile device, which access control terminal and access control method do not have at least some disadvantages of the prior art.

According to the present invention, these objects are achieved through the features of the independent claims. In addition, further advantageous embodiments follow from the dependent claims.

According to the present invention, the above-mentioned objects are particularly achieved by an access control terminal, comprising a first electronic circuit, a second electronic circuit, and an ultra-wideband transceiver connected to the first electronic circuit. The first electronic circuit is configured to activate periodically the ultra-wideband transceiver to receive ultra-wideband transmissions from a mobile device. Upon reception of an ultra-wideband transmission from a mobile device, the first electronic circuit is configured to activate the ultra-wideband transceiver to transmit to the mobile device a request message and to receive from the mobile device a response message. The first electronic circuit is configured to determine a distance of the mobile device from the access control terminal, using the response message, and to activate the second electronic circuit, if the mobile device has a distance within a pre-determined proximity range. The second electronic circuit is configured to execute access control for the mobile device, upon activation by the first electronic circuit.

In an embodiment, the first electronic circuit of the access control terminal is further configured to adapt the period for activating the ultra-wideband transceiver depending on the distance of the mobile device.

In an embodiment, the first electronic circuit of the access control terminal is further configured to adapt the period for activating the ultra-wideband transceiver depending on a number of ultra-wideband transmissions received from different mobile devices in a pre-determined period of time.

In an embodiment, the ultra-wideband transceiver of the access control terminal comprises two or more antennas. The first electronic circuit of the access control terminal is further configured to determine whether the ultra-wideband transmission was received from a front receiving direction or from a rear receiving direction, opposite to the front receiving direction, and to not activate the second electronic circuit, and/or to not select the mobile device for access control, if the ultra-wideband transmission was received from the rear receiving direction.

In an embodiment, the ultra-wideband transceiver of the access control terminal comprises two or more antennas. The first electronic circuit of the access control terminal is further configured to determine an angular direction at which the ultra-wideband transmission was received by the ultra-wideband transceiver, to determine a trajectory of movement of the mobile device, using distances and angular directions recorded for the mobile device, and to not activate the second electronic circuit, and/or to not select the mobile device for access control, if the trajectory of movement indicates that the mobile device passes by, and/or is moving away from, the access control terminal.

In an embodiment, the second electronic circuit of the access control terminal is further configured to execute the access control for the mobile device, having a distance within the pre-determined proximity range, using data included in the response message.

In addition to the access control terminal, the present invention also relates to an access control method between an access control terminal and a mobile device, the access control terminal comprising a first electronic circuit, a second electronic circuit, and an ultra-wideband transceiver connected to the first electronic circuit. The method comprises periodically activating the ultra-wideband transceiver, by the first electronic circuit, for receiving ultra-wideband transmissions from the mobile device. The method further comprises activating the ultra-wideband transceiver, by the first electronic circuit, and transmitting a request message to the mobile device, upon reception of an ultra-wideband transmission from the mobile device. The method further comprises determining, by the first electronic circuit, a distance of the mobile device from the access control terminal, using the response message. The method further comprises activating the second electronic circuit, by the first electronic circuit, if the mobile device has a distance within a pre-determined proximity range. The method further comprises executing access control for the mobile device, by the second electronic circuit, upon activation by the first electronic circuit.

In an embodiment, the method further comprises the first electronic circuit adapting the period for activating the ultra-wideband transceiver depending on the distance of the mobile device.

In an embodiment, the method further comprises the first electronic circuit adapting the period for activating the ultra-wideband transceiver depending on a number of ultra-wideband transmissions received from different mobile devices in a pre-determined period of time.

In an embodiment, the method further comprises the first electronic circuit using two or more antennas of the ultra-wideband transceiver to determine whether the ultra-wideband transmission was received from a front receiving direction or from a rear receiving direction, opposite to the front receiving direction. This embodiment further comprises the first electronic circuit not selecting the mobile device for access control, if the ultra-wideband transmission was received from the rear receiving direction.

In an embodiment, the method further comprises the first electronic circuit using two or more antennas of the ultra-wideband transceiver to determine an angular direction at which the ultra-wideband transmission was received by the ultra-wideband transceiver, to determine a trajectory of movement of the mobile device, using distances and angular directions recorded for the mobile device, and to not activate the second electronic circuit, and/or to not select the mobile device for access control, if the trajectory of movement indicates that the mobile device passes by, and/or is moving away from, the access control terminal.

In an embodiment, the method further comprises the second electronic circuit executing the access control for the mobile device, having a distance within the pre-determined proximity range, using data included in the response message.

In addition to an access control terminal and a method for access control method between an access control terminal and a mobile device, the present invention also relates to a computer program product. The computer program product comprises a non-transitory computer readable medium having stored thereon computer code configured to control a processor of an access control terminal. The access control terminal further comprises an ultra-wideband transceiver and an electronic circuit. The computer program product is configured to control the processor of the access control terminal such that the processor activates periodically the ultra-wideband transceiver for receiving ultra-wideband transmissions from a mobile device. The computer program product is further configured to control the processor of the access control terminal such that the processor activates the ultra-wideband transceiver and transmits a request message to the mobile device, upon reception of an ultra-wideband transmission from the mobile device. The computer program product is further configured to determine a distance of the mobile device from the access control terminal, using the response message. The computer program product is further configured to control the processor of the access control terminal such that the processor activates the electronic circuit, if the mobile device has a distance within a pre-determined proximity range, for the electronic circuit to execute access control for the mobile device.

In an embodiment, the computer program product has stored on the non-transient computer-readable medium further computer program code configured to control the processor of the access control terminal, such that the processor adapts the period for activating the ultra-wideband transceiver depending on the distance of the mobile device.

In an embodiment, the computer program product has stored on the non-transient computer-readable medium further computer program code configured to control the processor of the access control terminal, such that the processor adapts the period for activating the ultra-wideband transceiver depending on a number of ultra-wideband transmissions received from different mobile devices in a pre-determined period of time.

In an embodiment, the computer program product has stored on the non-transient computer-readable medium further computer program code configured to control the processor of the access control terminal, such that the processor uses two or more antennas of the ultra-wideband transceiver to determine whether the ultra-wideband transmission was received from a front receiving direction or from a rear receiving direction, opposite to the front receiving direction, and the processor does not activate the second electronic circuit, and/or to not select the mobile device for access control, if the ultra-wideband transmission was received from the rear receiving direction.

In an embodiment, the computer program product has stored on the non-transient computer-readable medium further computer program code configured to control the processor of the access control terminal, such that the processor uses two or more antennas of the ultra-wideband transceiver to determine an angular direction at which the ultra-wideband transmission was received by the ultra-wideband transceiver, to determine a trajectory of movement of the mobile device, using distances and angular directions recorded for the mobile device, and to not activate the second electronic circuit, and/or to not select the mobile device for access control, if the trajectory of movement indicates that the mobile device passes, and/or is moving away from, by the access control terminal.

In an embodiment, the computer program product has stored on the non-transient computer-readable medium further computer program code configured to control the processor of the access control terminal, such that the processor transfers data included in the response message to the electronic circuit, for the electronic circuit to execute access control for the mobile device, using data included in the response message.

BRIEF DESCRIPTION OF THE DRAWINGS

The present invention will be explained in more detail, by way of example, with reference to the drawings in which.

DETAILED DESCRIPTION OF THE PREFERRED EMBODIMENTS

Figure 1:
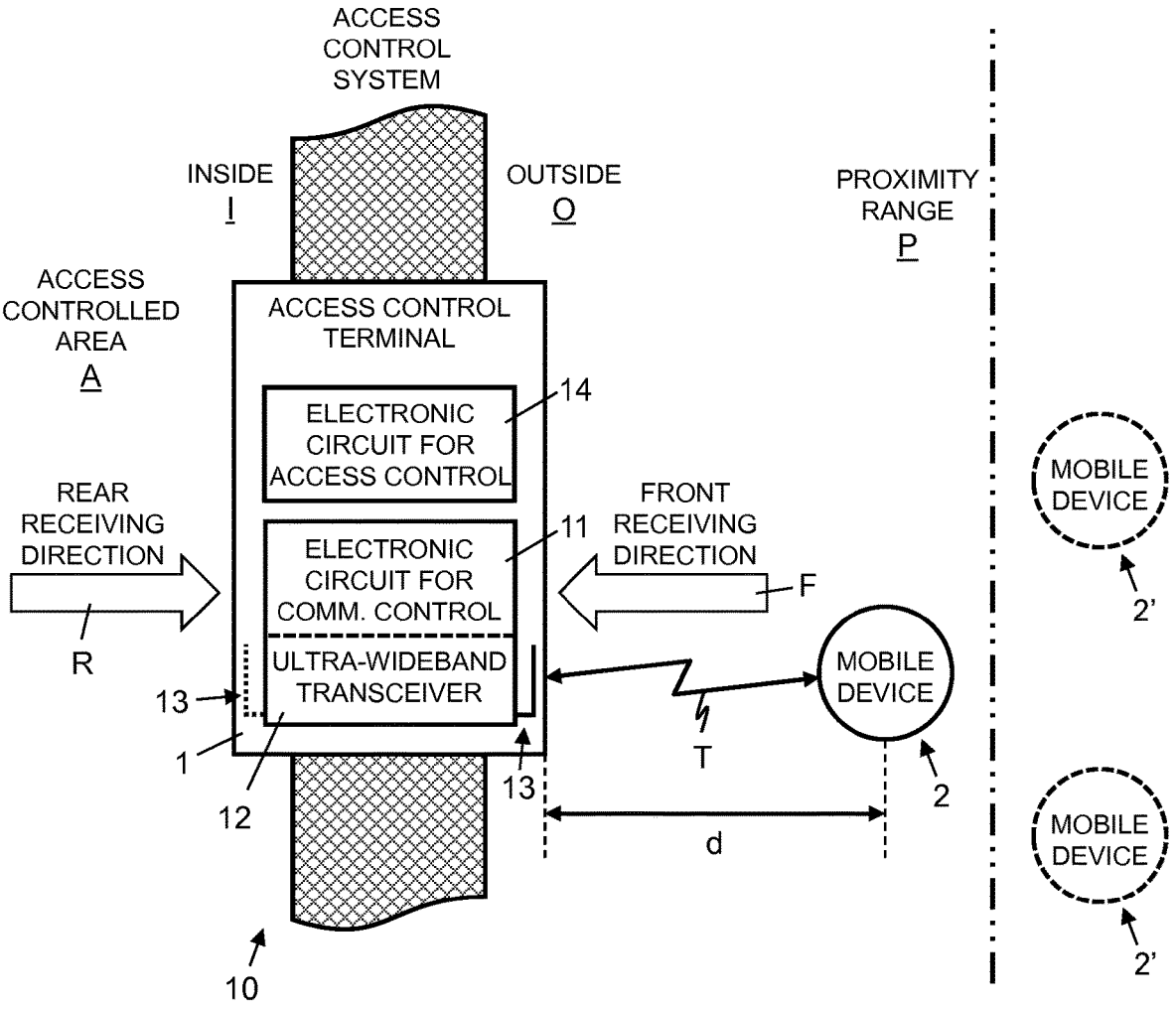
FIG. 1: shows a block diagram illustrating schematically an access control terminal and several mobile devices.

In FIG. 1, reference numerals 2, 2' refer to mobile devices, more specifically, mobile electronic devices such as mobile radio telephones (cellular phones), tablet computers, laptop computers, smart watches, key fobs, or other operable mobile electronic devices comprising a battery powered electronic circuit, e.g. a programmed processor and/or an application specific integrated circuit (ASIC), and an ultra-wideband transceiver described below in more detail in connection with access control terminal 1.

As illustrated schematically in FIG. 1, the access control terminal 1 is an electronic device which is part of an access control system 10, mounted on or in a wall near a doorway or access control location, or incorporated into a door or gate itself. As depicted in FIG. 1, the access control system 10 separates an access controlled area A, from an outside O of the access controlled area A. A device or person located in the access controlled area A is considered to be on an inside I, whereas, a device or person located outside the access controlled area A is considered to be on the outside O.

The access control terminal 1 comprises a first electronic circuit 11 for communications control and a second electronic circuit 14 for access control. The electronic circuit for access control 14 and the electronic circuit for communications control 11 are connected to each other and comprise a programmable processor, an application specific integrated circuit (ASIC), and/or other logic units configured to perform various functions and operations, as described later in more detail.

The electronic circuit for access control 14 is connected to a lock (not shown) and configured to generate a locking and/or unlocking signal for the lock to lock or unlock the door or gate such as to block or unblock access to the access controlled area A.

The access control terminal 1 further comprises an ultra-wideband transceiver 12 which is connected to the electronic circuit for communications control 11 and/or is part of the electronic circuit for communications control 11. For example, the ultra-wideband transceiver 12 and the electronic circuit for communications control 11 are printed on the same circuit board and/or are configured to use a common power supply.

The ultra-wideband transceiver 12 makes it possible to determine the distance d between the access control terminal 1 and a mobile device 2, 2'. More specifically, the ultra-wideband transceiver 12 makes it possible to determine the distance d on the basis of a round-trip time-of-flight measurement of ultra-wideband transmissions T between the ultra-wideband transceiver 12 of the access control terminal 1 and an (interoperable) ultra-wideband transceiver of a respective mobile device 2, 2', as outlined below in more detail.

In FIG. 1, reference numeral P refers to a proximity range P with respect to the access control terminal 1. As illustrated in FIG. 1, mobile devices 2' located with a distance from the access control terminal 1 greater than the proximity range P are considered as being outside the proximity range P, whereas a mobile device 2 located with a distance d from the access control terminal 1 smaller than or equal to the proximity range P is considered as being inside the proximity range P, respectively.

As illustrated schematically in FIG. 1, the access control terminal 1 or the ultra-wideband transceiver 12, respectively, comprises one or more antennas 13. In the case that the access control terminal 1 comprises a plurality of antennas 13, the plurality of antennas 13 are arranged such that they enable the electronic circuit for communications control 11 to distinguish between an ultra-wideband transmission T received by the ultra-wideband transceiver 12 from a front receiving direction F or a rear receiving direction R. In an embodiment, two antennas 13 are displaced from each other by a separation distance and arranged in parallel to a separator, e.g. a wall or door, between the inside I and outside O of the access controlled area A. The separation distance between these two antennas 13 is greater than a ranging error of determining a distance d between the mobile device 2 and an antenna 13 of the ultra-wideband transceiver 12. By separating the antennas 13 with a separation distance greater than the ranging error, it is possible to determine which of the two antennas 13 receives the ultra-wideband transmission T first. If the antenna 13 facing the outside O of the access controlled area A receives the ultra-wideband transmission T before the antenna 13 facing the inside I of the access controlled area A, the ultra-wideband transmission T was received from the front receiving direction F, i.e. from a mobile device 2 on the outside O of the access controlled area A. Conversely, if the antenna 13 facing the inside I of the access controlled area A receives the ultra-wideband transmission T before the antenna 13 facing the outside O of the access controlled area A, the ultra-wideband transmission T was received from the rear receiving direction R, i.e. from a mobile device 2 on the inside I of the access controlled area A.

In a further embodiment where the access control terminal 1 comprises a plurality of antennas 13, the plurality of antennas 13 are arranged such that they enable the electronic circuit for communications control 11 to determine the approximate angular direction from where the ultra-wideband transmission T is received by the ultra-wideband transceiver 12. In an embodiment, two antennas 13 are arranged, at a defined distance from each other, along an axis running parallel to the separator, e.g. a wall or door, between the inside I and outside O of the access controlled area A. From the individual distance values determined for each of the two antennas 13, between the mobile device 2 and the respective antenna 13, the electronic circuit for communications control 11 determines the approximate angular direction from where the ultra-wideband transmission T was received, through trigonometric calculations (not taking into consideration the actual height or altitude of the location of the mobile device 2, 2', respectively). Using the determined distance and angular direction of the mobile devices 2, 2', with respect to the access control terminal 1, the electronic circuit for communications control 11 tracks the approximate movement or trajectory of movement of the mobile devices 2, 2', such as to determine whether a particular mobile device 2, 2' or its user, respectively, approaches the access control terminal 1 to access the access controlled area A or merely passes by, and/or moves away from, the access control terminal 1 and access controlled area A.

Using a plurality of three and more antennas 13, makes it possible to the electronic circuit for communications control 11 to determine the approximate angular direction and the front or rear receiving direction F, R of the ultra-wideband transmission T from the mobile device 2 in addition to the distance of the mobile device 2 from the access control terminal 1.

The electronic circuit for communications control 11 is configured to switch the ultra-wideband transceiver 12 between a plurality of operating modes, including a sleep mode and an active mode. In the sleep mode, the ultra-wideband transceiver 12 consumes no electrical energy or at least less energy than in the active mode. In an embodiment, the electronic circuit for communications control 11 is configured to switch the ultra-wideband transceiver 12 to sleep mode by disconnecting it from a power supply. Alternatively, the electronic circuit for communications control 11 is configured to switch the ultra-wideband transceiver 12 to sleep mode by sending the ultra-wideband transceiver 12 a signal, such that the ultra-wideband transceiver 12 enters a low power state from a high power state, or uses other power management methods to selectively switch off internal circuitry of the ultra-wideband transceiver 12 to reduce the consumption of electrical energy. In the sleep mode, the ultra-wideband transceiver 12 is inactive and does not receive any ultra-wideband transmissions T from a mobile device 2, 2', nor does it transmit any ultra-wideband transmissions T. The electronic circuit for communications control 11 comprises a timer module, e.g. a programmed timer module or a timer circuit, which is configured to switch the ultra-wideband transceiver 12 to active mode, after a sleep period has elapsed. The electronic circuit for communications control 11 is configured to switch the ultra-wideband transceiver 12 from sleep mode to active mode by reconnecting it to the power supply, or by sending to the ultra-wideband transceiver 12 a signal such that the ultra-wideband transceiver 12 switches from the low power state to the high power state.

When the ultra-wideband transceiver 12 is in the active mode, it is operational to receive ultra-wideband transmissions T from mobile devices 2, 2'. The electronic circuit for communications control 11 is configured to control the ultra-wideband transceiver 12 to remain in the active mode, or the ultra-wideband transceiver 12 is configured to remain in the active mode, respectively, for a listening period of at least 200 milliseconds to ensure that an ultra-wideband transmission T from the mobile device 2 is received in its entirety.

The electronic circuit for communications control 11 is further configured to switch the electronic circuit for access control 14 between a plurality of operating modes, including a sleep mode and an active mode, as outlined above in connection with the ultra-wideband transceiver 12. In the sleep mode, the electronic circuit for access control 14 consumes no electrical energy or at least less energy than in the active mode. By default, the electronic circuit for access control 14 is in sleep mode.

Data transfer between the electronic circuit for communications control 11 and the ultra-wideband transceiver 12, and between the electronic circuit for communications control 11 and the electronic circuit for access control 14 takes place using a communication interface, which may be synchronous, such as the synchronous serial interface (SSI) and Ethernet, or asynchronous, such as supported by RS-232.

The access control terminal 1 further comprises a memory module which may record data such as a response message from a mobile device 2, 2', which response message comprises an identifier of the mobile device 2, 2', identification data of the user, and an indication of a distance d between the mobile device 2, 2' and the ultra-wideband transceiver 12 of the access control terminal 1.

Figure 2:
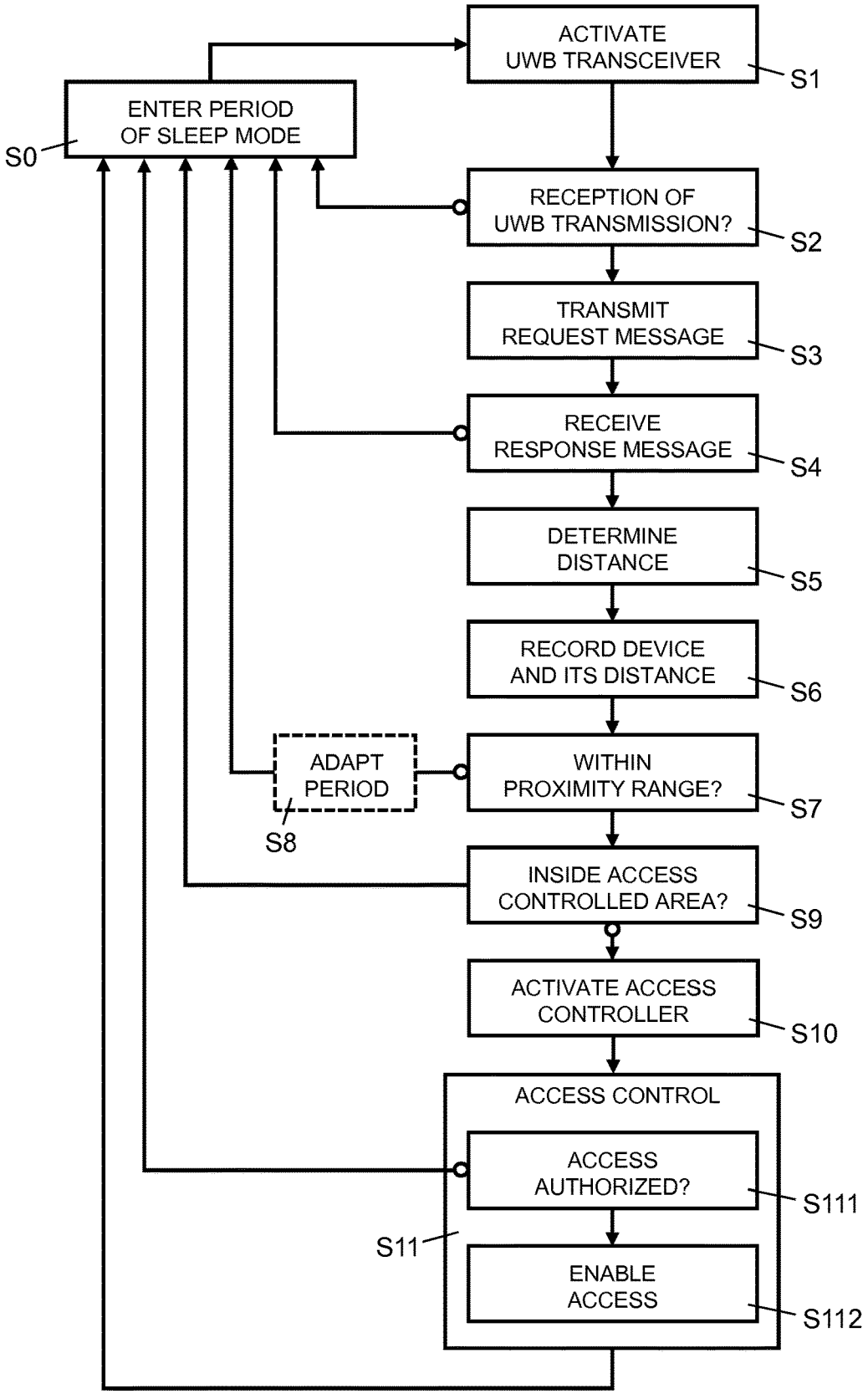
FIG. 2: shows a flow diagram illustrating an exemplary sequence of steps for access control between an access control terminal and a mobile device.

In the following paragraphs, described with reference to FIG. 2 are the steps, functions, and operations performed by the electronic circuit for communications control 11, the ultra-wideband transceiver 12, and the electronic circuit for access control 14, respectively, for performing access control between the access control terminal 1 and one or more mobile devices 2, 2'.

Departing from step S0, the ultra-wideband transceiver 12 and the electronic circuit for access control 14 are in sleep mode. Depending on the state and context, as will be described below in more detail, in step S0, the ultra-wideband transceiver 12 and/or the electronic circuit for access control 14 are switched into sleep mode by the electronic circuit for communications control 11.

In step S1, the electronic circuit for communications control 11 activates the ultra-wideband transceiver 12 by switching it into the active mode. The period of sleep mode has the default value in the range of a half to three seconds, for example one second. Thus the ultra-wideband transceiver 12 remains in sleep mode until the period of sleep mode has elapsed, after which the electronic circuit for communications control 11 activates the ultra-wideband transceiver 12 in step S1.

While active, the ultra-wideband transceiver 12 is operative to receive ultra-wideband transmissions T from a mobile device 2, 2'. The ultra-wideband transceiver 12 by default remains active for a period of hundred to five hundred milliseconds, e.g. for two hundred milliseconds. In an embodiment, this period is variable and can be adapted.

In step S2, the electronic circuit for communications control 11 checks if an ultra-wideband transmission T from a mobile device 2, 2' was received by the ultra-wideband transceiver 12. If no ultra-wideband transmission T was received during the active period, the ultra-wideband transceiver 12 is deactivated, e.g. by the electronic circuit for communications control 11 switching the ultra-wideband transceiver 12 to sleep mode in step S0. If an ultra-wideband transmission T was received during the active period, the electronic circuit for communications control 11 directs the ultra-wideband transceiver 12 to proceed in step S3.

In step S3, the ultra-wideband transceiver 12 transmits a request message to the mobile device 2, from which the ultra-wideband transmission T was received in step S2.

In step S4, the electronic circuit for communications control 11 checks if the ultra-wideband transceiver 12 received a response message from the mobile device 2 addressed in step S3. If the ultra-wideband transceiver 12 does/did not receive a response message from the mobile device 2 within a defined waiting period, the ultra-wideband transceiver 12 is deactivated, e.g. by the electronic circuit for communications control 11 switching the ultra-wideband transceiver 12 to sleep mode in step S0. If the ultra-wideband transceiver 12 receives the response message from the mobile device 2, processing continues in step S5.

In step S5, the electronic circuit for communications control 11 determines the distance d of the mobile device 2 from the ultra-wideband transceiver 12. The distance d is determined in the electronic circuit for communications control 11 on the basis of a round-trip time-of-flight measurement. The round-trip time-of-flight measurement is based on a time difference between the ultra-wideband transceiver 12 transmitting the request message to the mobile device 2 in step S3, and the ultra-wideband transceiver 12 receiving the response message from the mobile device 2 in step S4. An accurate representation of the mobile device 2 processing time, i.e. the time it takes between the reception of the request value by the mobile device 2 and the transmitting of the response message by the mobile device 2, is stored either in the mobile device 2 or in the electronic circuit for communications control 11. By accounting for the processing time, the electronic circuit for communications control 11 determines the distance d between the antenna 13 of the ultra-wideband transceiver 12 and the mobile device 2. In an embodiment, the electronic circuit for communications control 11 further determines the approximate angular direction of the mobile device 2 with respect to the ultra-wideband transceiver 12 or access control terminal 1, respectively, as described above in more detail.

In step S6, the electronic circuit for communications control 11 stores an identifier of the mobile device 2 and the distance d of the mobile device 2 from the ultra-wideband transceiver 12 in a data store, e.g. a memory module of the electronic circuit for communications control 11. Depending on the embodiment, the electronic circuit for communications control 11 further stores the angular direction of the mobile device 2 with respect to the ultra-wideband transceiver 12 or access control terminal 1, respectively.

In step S7, the electronic circuit for communications control 11 checks whether the recorded distance d is within the proximity range P. If the recorded distance indicates that the mobile device 2 is outside the proximity range P, the ultra-wideband transceiver 12 is deactivated, e.g. by the electronic circuit for communications control 11 switching the ultra-wideband transceiver 12 to sleep mode in step S0. Otherwise, if the recorded distance indicates that the mobile device 2 is within the proximity range P, processing continues in step S9. Depending on the embodiment, the electronic circuit for communications control 11 further determines from distances and angular directions recorded for the mobile device 2, a trajectory of movement of the mobile device 2 or its user, respectively, and determines from the trajectory of movement whether the mobile device 2 or its user, respectively, actually approaches the access control terminal 1 to access the access controlled area A or merely appears to pass by, and/or move away from, the access control terminal 1 and the access controlled area A. If the determined trajectory of movement indicates that the mobile device 2 passes by, and/or moves away from, the access control terminal 1, the ultra-wideband transceiver 12 is deactivated, e.g. by the electronic circuit for communications control 11 switching the ultra-wideband transceiver 12 to sleep mode in step S0. Otherwise, if the determined trajectory of movement indicates that the mobile device 2 approaches the access control terminal 1 to enter the access controlled area A, processing continues in step S9.

In an embodiment, in step S8, the electronic circuit for communications control 11 adapts the length of the period of sleep mode for the ultra-wideband transceiver 12 depending on the distance d of the detected mobile device 2 and the access control terminal 1 and/or depending on the number of mobile devices 2, 2' detected within a defined monitoring time window.

For example, if a proximity range P, within which access control by the electronic circuit for access control 14 is performed, is two meters, and the detected distance d between the mobile device 2 and the access control terminal 1 is determined by the electronic circuit for communications control 11 to be twenty meters, the electronic circuit for communications control 11 increases the sleep period, for example from a default sleep period of one second to a longer sleep period of three seconds. On the other hand, if the distance d is determined to be only slightly larger than the proximity range P, such as three meters for a given proximity range P of two meters, the electronic circuit for communications control 11 reduces the sleep period, for example from the default sleep period of one second to a shorter sleep period of half a second. Adapting the sleep period between activating the ultra-wideband transceiver 12 further increases the energy efficiency of the access control terminal 1, as it reduces the consumption of electrical energy during times when mobile devices 2, 2' are located at a great distance from the proximity range P. Adapting the sleep period between activating the ultra-wideband transceiver 12 also reduces the time it takes for access control to take place by reducing the sleep period during times when the mobile device 2 is close to the proximity range P.

For adapting the length of the period of sleep mode depending on the number of mobile devices 2, 2' detected within a defined monitoring time window, the electronic circuit for communications control 11 determines the number of ultra-wideband transmissions T received from different mobile devices 2 within the monitoring time window. For example, if one or more mobile devices 2 were detected within the monitoring time window, the sleep period between activating the ultra-wideband transceiver 12 may be reset from a previously increased duration to the default period. If, however, no transmissions from mobile devices 2 are detected within the monitoring time window, then the sleep period may be increased from the default sleep period to a longer sleep period, which may be defined depending on the dimensions of the space in front of the access control terminal 1, such as to ensure detection of a mobile device 2, 2' appearing inside said space. The sleep period may also be adapted according to the time of day and the calendar date. For example during normal office hours the sleep period may be reduced as it is expected that access control will take place more frequently than outside office hours. Similarly, during weekends the sleep period may be reduced. The sleep period may also be adapted according to the outputs of an algorithm which analyzes the frequency of access control as a function of the time of day and the calendar date. During times of higher predicted access control the sleep period would be smaller, and during times of lower predicted access control the sleep period would increase. The above measures result in a more energy efficient access control terminal 1, as the ultra-wideband transceiver 12 enters sleep mode for greater sleep periods when the demand for access control is reduced.

In step S9, the electronic circuit for communications control 11 checks whether the mobile device 2 is inside the access controlled area A. This check requires a plurality of antennas 13 spaced such that a difference in the round-trip time-of-flight measurement between the antennas 13 can be used to determine whether the mobile device 2 is on the inside I of the access controlled area A or on the outside O of the access controlled area A, as described above. If the mobile device 2 is inside the access controlled area A, the ultra-wideband transceiver 12 is deactivated, e.g. by the electronic circuit for communications control 11 switching the ultra-wideband transceiver 12 to sleep mode in step S0. If the mobile device 2 is not inside the access controlled area A, i.e. if it is outside the access controlled area A, processing continues in step S10.

In step S10, the electronic circuit for communications control 11 activates the electronic circuit for access control by switching the electronic circuit for access control 14 from sleep mode into active mode, as described above.

In step S11, the electronic circuit for access control 14 performs access control. Specifically, in active mode, the electronic circuit for access control 14 verifies whether a user associated with the detected mobile device 2 is authorized for access, using identification data received from the mobile device 2 in the response message in step S4 or in a separate ultra-wideband transmission T. For verifying authorization, the electronic circuit for access control 14 uses authorization data stored either in the access control terminal 1 itself or in a remote database, for example.

If the mobile device 2 is not authorized for access then, in step S111, the ultra-wideband transceiver 12 and the electronic circuit for access control 14 are deactivated, e.g. by the electronic circuit for communications control 11 switching the ultra-wideband transceiver 12 and the electronic circuit for access control 14 to sleep mode in step S0.

If the electronic circuit for access control 14 authorizes access for the user of the mobile device 2 then, in step S112, access is granted and the electronic circuit for access control 14 generates an unlocking signal for a lock to unlock the door or gate such as to unblock access to the access controlled area A, allowing the user in possession of the mobile device 2 to gain access to the access controlled area A. Subsequently, the ultra-wideband transceiver 12 and the electronic circuit for access control 14 are deactivated, e.g. by the electronic circuit for communications control 11 switching the ultra-wideband transceiver 12 and the electronic circuit for access control 14 to sleep mode in step S0.

What is claimed is:

1. An access control terminal, comprising:

a first electronic circuit, a second electronic circuit, and an ultra-wideband transceiver connected to the first electronic circuit;

wherein the first electronic circuit is configured to:

activate periodically the ultra-wideband transceiver to receive ultra-wideband transmissions from a mobile device, wherein activating the ultra-wideband transceiver comprises switching the ultra-wideband transceiver from a sleep mode into an active mode, upon reception of an ultra-wideband transmission from the mobile device, activate the ultra-wideband transceiver to transmit to the mobile device a request message and to receive from the mobile device a response message, determine a distance of the mobile device from the access control terminal, using the response message, and in response to a determination that the distance of the mobile device from the access control terminal is within a pre-determined proximity range, activate the second electronic circuit, wherein activating the second electronic circuit comprises switching the second electronic circuit from a sleep mode into an active mode, wherein the second electronic circuit operates in the sleep mode until activated by the first electronic circuit; and wherein the second electronic circuit is configured to execute access control for the mobile device, upon activation by the first electronic circuit.

2. The access control terminal of claim 1, wherein the first electronic circuit is further configured to adapt the period for activating the ultra-wideband transceiver depending on the distance of the mobile device.

3. The access control terminal of claim 1, wherein the first electronic circuit is further configured to adapt the period for activating the ultra-wideband transceiver depending on a number of ultra-wideband transmissions received from different mobile devices in a pre-determined period of time.

4. The access control terminal of claim 1, wherein the ultra-wideband transceiver comprises two or more antennas; and the first electronic circuit is further configured to determine whether the ultra-wideband transmission was received from a front receiving direction or from a rear receiving direction, opposite to the front receiving direction, and to not select the mobile device for access control, if the ultra-wideband transmission was received from the rear receiving direction.

5. The access control terminal of claim 1, wherein the ultra-wideband transceiver comprises two or more antennas; and the first electronic circuit is further configured to determine an angular direction at which the ultra-wideband transmission was received by the ultra-wideband transceiver, to determine a trajectory of movement of the mobile device, using distances and angular directions recorded for the mobile device, and to not select the mobile device for access control, if the trajectory of movement indicates that the mobile device passes by the access control terminal.

6. The access control terminal of claim 1, wherein the second electronic circuit is further configured to execute the access control for the mobile device, having a distance within the pre-determined proximity range, using data included in the response message.

7. An access control method between an access control terminal and a mobile device, the access control terminal comprising a first electronic circuit, a second electronic circuit, and an ultra-wideband transceiver connected to the first electronic circuit, wherein the method comprises:

activating periodically the ultra-wideband transceiver, by the first electronic circuit, for receiving ultra-wideband transmissions from the mobile device;

activating the ultra-wideband transceiver, by the first electronic circuit, and transmitting a request message to the mobile device, upon reception of an ultra-wideband transmission from the mobile device, wherein activating the ultra-wideband transceiver comprises switching the ultra-wideband transceiver from a sleep mode into an active mode;

determining, by the first electronic circuit, a distance of the mobile device from the access control terminal, using a response message;

activating the second electronic circuit, by the first electronic circuit, if the mobile device has a distance within a pre-determined proximity range, wherein activating the second electronic circuit comprises switching the second electronic circuit from a sleep mode into an active mode, wherein the second electronic circuit operates in the sleep mode until activated by the first electronic circuit; and executing access control for the mobile device, by the second electronic circuit, upon activation by the first electronic circuit.

8. The access control method of claim 7, wherein the method further comprises the first electronic circuit adapting the period for activating the ultra-wideband transceiver depending on the distance of the mobile device.

9. The access control method of claim 7, wherein the method further comprises the first electronic circuit adapting the period for activating the ultra-wideband transceiver depending on a number of ultra-wideband transmissions received from different mobile devices in a pre-determined period of time.

10. The access control method of claim 7, wherein the method further comprises the first electronic circuit using two or more antennas of the ultra-wideband transceiver to determine whether the ultra-wideband transmission was received from a front receiving direction or from a rear receiving direction, opposite to the front receiving direction; and the first electronic circuit not selecting the mobile device for access control, if the ultra-wideband transmission was received from the rear receiving direction.

11. The access control method of claim 7, wherein the method further comprises the first electronic circuit using two or more antennas of the ultra-wideband transceiver to determine an angular direction at which the ultra-wideband transmission was received by the ultra-wideband transceiver, to determine a trajectory of movement of the mobile device, using distances and angular directions recorded for the mobile device, and to not select the mobile device for access control, if the trajectory of movement indicates that the mobile device passes by the access control terminal.

12. The access control method of claim 7, wherein the method further comprises the second electronic circuit executing the access control for the mobile device, having a distance within the pre-determined proximity range, using data included in the response message.

13. A computer program product comprising a non-transitory computer readable medium having stored thereon computer code configured to control a processor of an access control terminal comprising an ultra-wideband transceiver connected to a first electronic circuit and a second electronic circuit, such that the processor performs the steps of:

activating periodically the ultra-wideband transceiver for receiving ultra-wideband transmissions from a mobile device;

activating the ultra-wideband transceiver and transmitting a request message to the mobile device, upon reception of an ultra-wideband transmission from the mobile device, wherein activating the ultra-wideband transceiver comprises switching the ultra-wideband transceiver from a sleep mode into an active mode;

determining a distance of the mobile device from the access control terminal, using a response message; and activating the second electronic circuit, if the mobile device has a distance within a pre-determined proximity range, for the second electronic circuit to execute access control for the mobile device, wherein activating the second electronic circuit comprises switching the second electronic circuit from a sleep mode into an active mode, wherein the second electronic circuit operates in the sleep mode until activated by the first electronic circuit.

14. The computer program product of claim 13, wherein the computer code is further configured to control the processor of the access control terminal, such that the processor adapts the period for activating the ultra-wideband transceiver depending on the distance of the mobile device.

15. The computer program product of claim 13, wherein the computer code is further configured to control the processor of the access control terminal, such that the processor adapts the period for activating the ultra-wideband transceiver depending on a number of ultra-wideband transmissions received from different mobile devices in a pre-determined period of time.

16. The computer program product of claim 13, wherein the computer code is further configured to control the processor of the access control terminal, such that the processor uses two or more antennas of the ultra-wideband transceiver to determine whether the ultra-wideband transmission was received from a front receiving direction or from a rear receiving direction, opposite to the front receiving direction; and the processor does not select the mobile device for access control, if the ultra-wideband transmission was received from the rear receiving direction.

17. The computer program product of claim 13, wherein the computer code is further configured to control the processor of the access control terminal, such that the processor uses two or more antennas of the ultra-wideband transceiver to determine an angular direction at which the ultra-wideband transmission was received by the ultra-wideband transceiver, to determine a trajectory of movement of the mobile device, using distances and angular directions recorded for the mobile device, and to not select the mobile device for access control, if the trajectory of movement indicates that the mobile device passes by the access control terminal.

18. The computer program product of claim 13, wherein the computer code is further configured to control the processor of the access control terminal, such that the processor transfers data included in the response message to the second electronic circuit, for the second electronic circuit to execute access control for the mobile device, using data included in the response message.

* * * * *